United States Patent [19]

Meijer

[11] 4,016,720

[45] Apr. 12, 1977

[54] HOT-GAS RECIPROCATING ENGINE

[75] Inventor: Roelf Jan Meijer, Eindhoven, Netherlands

[73] Assignee: U.S. Philips Corporation, New York, N.Y.

[22] Filed: Mar. 22, 1976

[21] Appl. No.: 669,323

[30] Foreign Application Priority Data

Apr. 1, 1975 Netherlands ..... 7503828

[52] U.S. Cl. ..... 60/524; 60/525; 60/659

[51] Int. Cl.[2] ..... F02G 1/06

[58] Field of Search ..... 60/517–526, 60/659

[56] References Cited

UNITED STATES PATENTS 3,959,971 6/1976 Mekari ..... 60/517

*Primary Examiner*—Allen M. Ostrager
*Attorney, Agent, or Firm*—Frank R. Trifari; David R. Treacy

[57] ABSTRACT

A hot-gas reciprocating engine comprising at least three pistons which each separate a space of lower temperature and a space of higher temperature. Each space of lower temperature is each time connected, via a regenerator and a heat exchanger which is in heat-exchanging contact with a reservoir containing heat-accummulating material, to a space of higher temperature having volume variations which lead in phase as well as to a space of higher temperature having volume variations which lag in phase. The said connections include valves which are operated by means for selectively releasing one of the two connections, each of the pistons co-operating, by way of a drive rod, with a tiltable plate which is mounted on a rotatable shaft. When the connections between the spaces of lower temperature and the relevant spaces of higher temperature with volume variations which lag in phase are released, the valve control means take along the independently operable means for tilting the plate in order to tilt the plate further.

1 Claim, 3 Drawing Figures

HOT-GAS RECIPROCATING ENGINE

The invention relates to a hot-gas reciprocating engine comprising at least three double-acting pistons which are each reciprocable in an associated cylinder and which each separate therein a space of variable volume and lower temperature during operation from a space of variable volume and higher temperature during operation, the space of lower temperature in each cylinder being connected, via one of a plurality of regenerators and one of a plurality of heat exchangers to the space of higher temperature in one of the other cylinders, the volume variations of each space of higher temperature leading in phase those of the space of lower temperature connected thereto, at least one heating device being provided for supplying heat to the heat exchangers, which device comprises at least one reservoir which contains a heat-storing material which can be heated and which material is in heat-exchanging relationship with the heat-exchangers during operation, each of the pistons being coupled to a drive rod which co-operates, by way of a sliding body, with a swash-plate which is tiltably mounted on a rotatable shaft, and means being provided for tilting the swash-plate to increase or decrease its inclination relative to the shaft in order to increase or decrease, respectively, the stroke of the pistons.

A hot-gas engine of the kind set forth is known from the article "The Potential of the Philips Stirling Engine for Pollution Reduction and Energy Conservation" (paper presented at the Second Symposium on Low Pollution Power Systems Development, Dusseldorf, Germany, Nov. 4–8, 1974).

In this known hot-gas reciprocating engine, which is used for vehicle propulsion, heat stored in a heat accummulator is applied to the heat exchangers ("heaters") via a heat-transporting medium which completes an evaporation/condensation cycle in a closed space ("heat pipe").

A drive which utilizes a tiltable rotatable swash-plate is known in the art as an "adjustable swash-plate drive". The tilting of the plate can be effected, for example, about a fixed axis extending transversely of the axis of rotation of the swash-plate, or by rotation about a Z-axis.

When the swash-plate is tilted, the stroke of the pistons co-operating with the plate changes. This causes a change of the power delivered by the hot-gas reciprocating engine, and in this manner power control of the engine is achieved. The stroke of the pistons becomes greater as the inclination of the swash-plate with respect to its axis of rotation increases. A longer stroke of the pistons results in a larger volume variation and a larger compression ratio of the working medium in the working space. Consequently, the torque delivered by the engine will be higher. When the swash-plate occupies a position substantially perpendicular to the axis of rotation, the torque delivered is zero. This means that the engine cannot deliver a significant reverse torque by adjustment of the plate, so that engine-braking cannot be effected in this manner. However, in a hot-gas reciprocating engine of the above kind which is used for vehicle propulsion, engine braking is very desirable.

The present invention has for its object to provide a hot-gas reciprocating engine of the kind set forth wherein smooth engine braking is possible and wherein the braking energy is also effectively used.

To realize this object, the hot-gas reciprocating engine according to the invention is characterized in that each space of lower temperature is also connected, via one of the regenerators, and one of the heat exchangers to one of the spaces of higher temperature in which space the volume variations lag in phase behind those in the space of lower temperature connected thereto, the connections between each space of lower temperature and the two spaces of higher temperature connected thereto including valves which are operated by means of selectively opening one of the two connections, which means, when opening the connections between the spaces of lower temperature and the spaces of higher temperature wherein the volume variations occur which lag in phase behind those in the relevant space of lower temperature, causes the means for tilting the swash-plate to be operated to tilt the plate further in the direction to increase its inclination, the means for tilting the plate being operable independently of the means for selectively opening one of the two connections.

It is thus achieved that, when there is a change-over from open connections between the spaces of lower temperature and the relevant spaces of higher temperature with phase-leading volume variations to open connections between the spaces of lower temperature and the relevant spaces of higher temperature with phase-lagging volume variations, the engine starts to act as a heat pump, while maintaining the original direction of rotation, which converts braking energy (reverse torque) applied to the motor shaft into heat in the spaces of higher temperature. This heat is stored in the heat-storing material and is therefore not lost.

Because of the fact that during the described change-over of the connections the swash-plate is also adjusted to a position in which it is more inclined with respect to the axis of rotation, the braking torque increases continuously and smoothly and an increasing amount of heat energy is pumped (back) to the heat-storing material.

An embodiment of the invention will be described in detail hereinafter with reference to the accompanying diagrammatic drawings which are not to scale.

Figure 1:
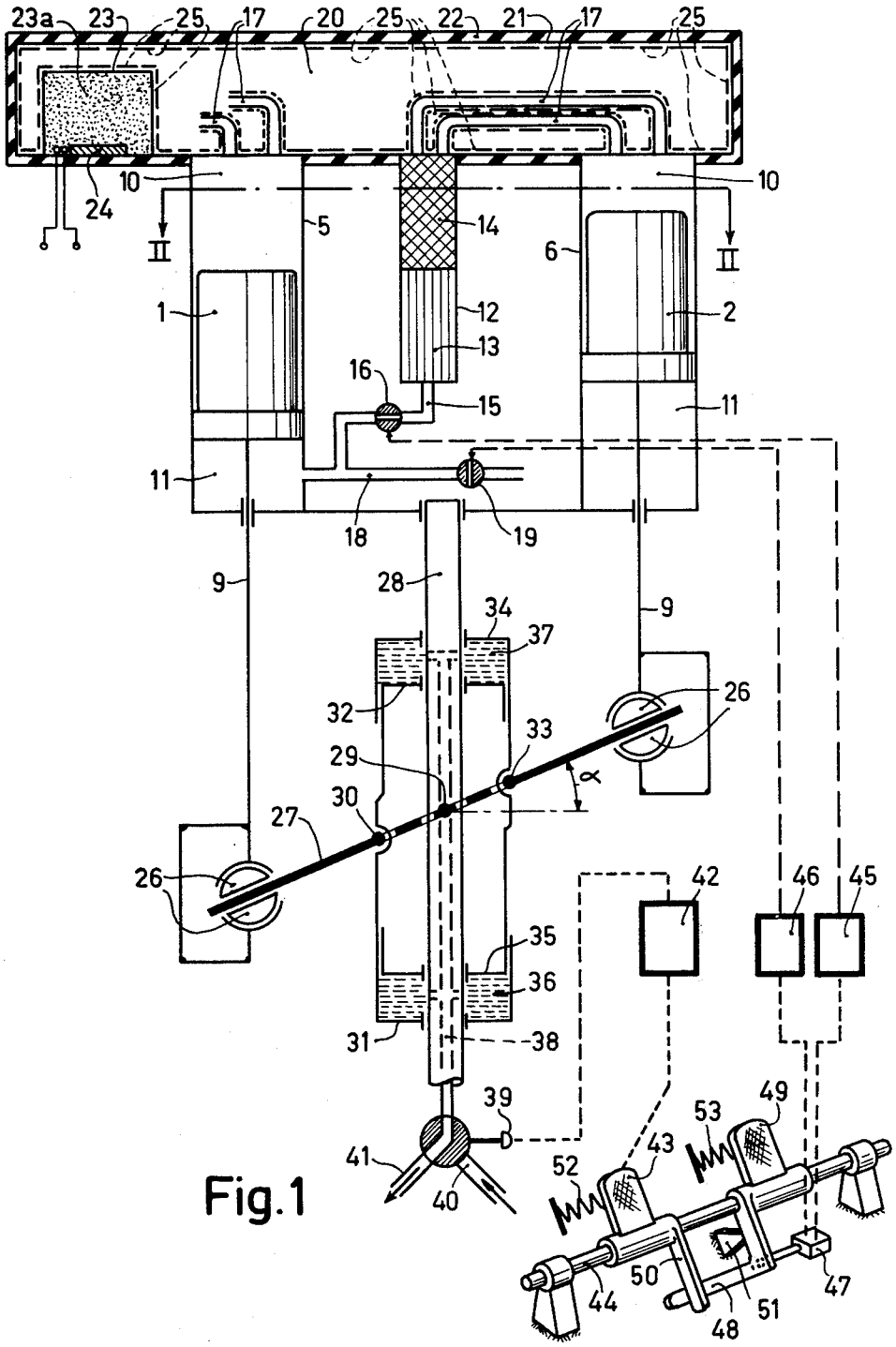
FIG. 1 is a longitudinal sectional view of a four-cylinder double-acting hot-gas engine (partly taken along the line I—I of FIG. 2) with some control members shown in perspective.
Figure 2:
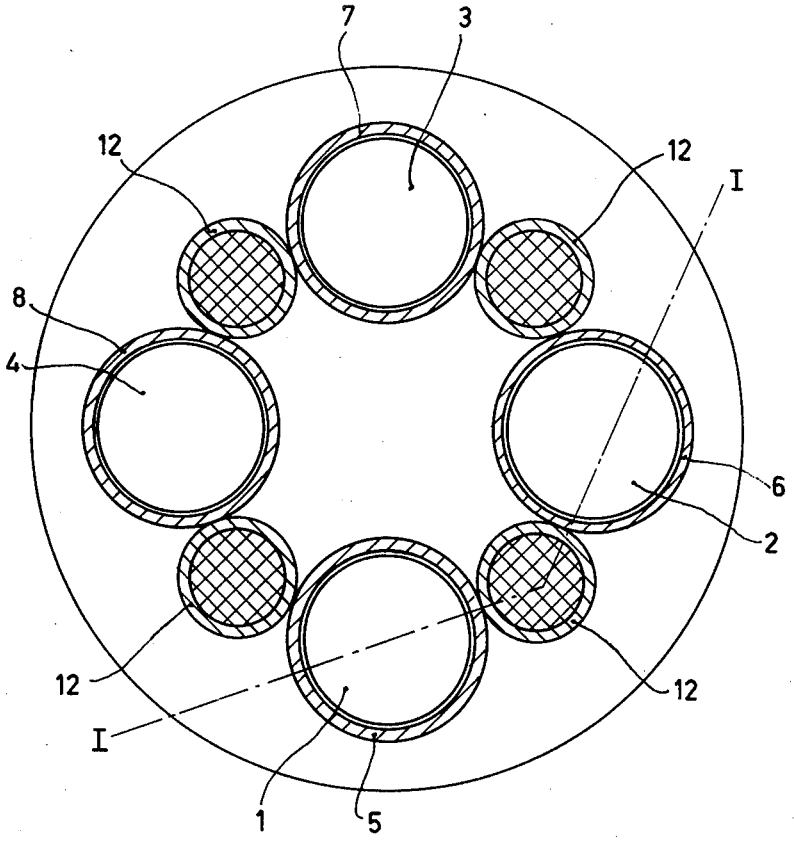
FIG. 2 is a cross-sectional view at the area of the line II—II of FIG. 1.
Figure 3:
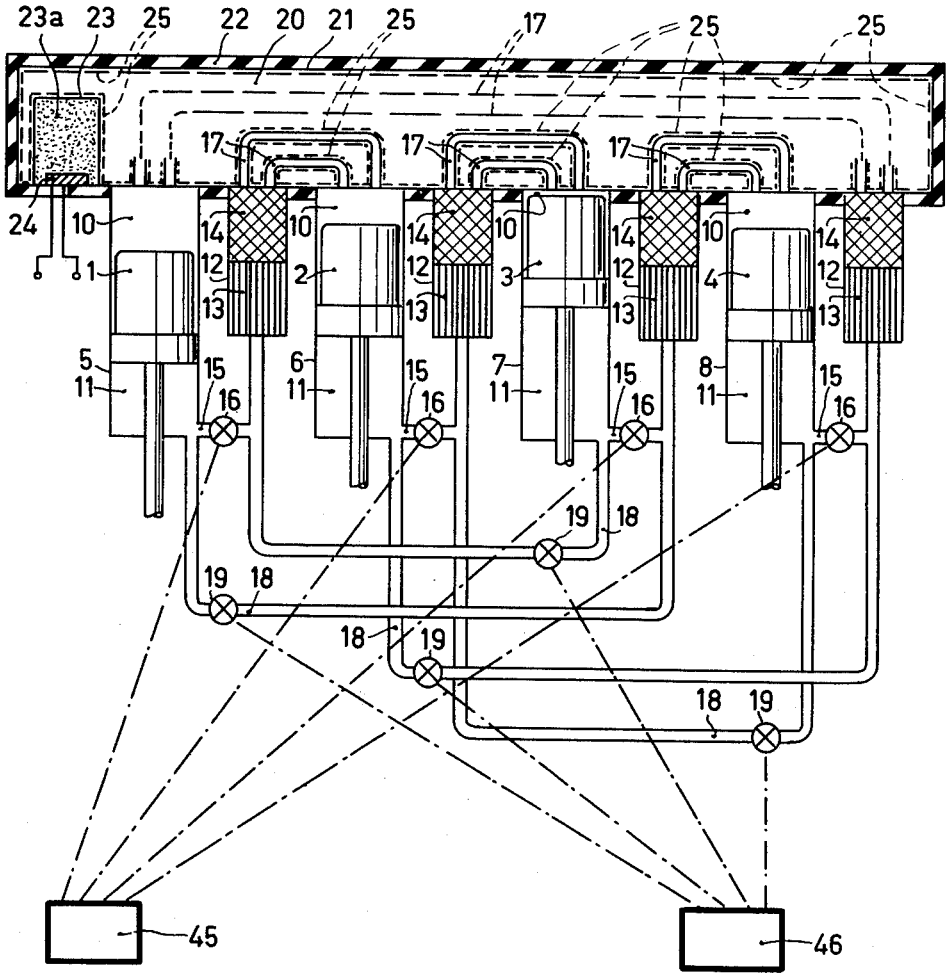
FIG. 3 is a developed view showing the connections between the spaces of variable volume in the hot-gas engine shown in FIGS. 1 and 2.

The hot-gas engine comprises four double-acting pistons 1, 2, 3, and 4 which are movable with a phase difference with respect to each other and which are accommodated in four cylinders 5, 6, 7 and 8. Each of the pistons 1, 2, 3 and 4 is provided with a drive rod 9 which is guided through the closed lower end of the respective cylinder in a sealing manner and connected to a drive.

In each cylinder the respective piston 1, 2, 3 and 4 separates a space 10 of higher temperature from a space 11 of lower temperature. Four units 12 which each comprise a cooler 13 and a regenerator 14 are arranged between the cylinders 5, 6, 7 and 8.

The space 11 of lower temperature in the cylinder 5 communicates, via a duct 15 including a valve 16 via one of the units 12 and via heater pipes 17, with the space 10 of higher temperature in the cylinder 6. Similarly, the space of lower temperature in the cylinder 6, 7 and respectively 8 communicates with the space of higher temperature in the cylinder 7, 8 and 5, respectively.

During normal operation of the engine as a prime mover, the four pairs of spaces interconnected in the described manner constitute four working spaces which contain a working medium, for example, hydrogen or helium. In each pair of interconnected spaces the volume variations of the space of higher temperature lead in phase the volume variations of the space of lower temperature.

The space 11 of lower temperature in the cylinder 5 also communicates with the space 10 of higher temperature in the cylinder 8, via a duct 18 which includes a valve 19, via one of the units 12 and via heater pipes 17. Similarly, the space 11 of lower temperature in the cylinder 6, 7 and respectively 8 communicates with the space 10 of higher temperature in the cylinder 5, 6 and 7, respectively. In each of these pairs of interconnected spaces the volume variations of the space of higher temperature lag in phase behind the volume variations of the space of lower temperature.

The heater pipes 17 are arranged in a closed space 20 bounded by the walls of a closed tube 21 which is heat-insulated from the surroundings by a layer of heat-insulating material 22. Inside the tube 21 there is also provided a closed reservoir 23, the major part of which is filled with a heat-storing material 23a, for example, LiF, that can be applied to melt this metal salt by means of an electrical heating element 24.

The inner surfaces of the walls of the tube 21 and the outer surfaces of the walls of the reservoir 23 and the heater pipes 17 are provided with a lining 25 having a capillary structure, for example, a wick consisting of one or more layers of metal gauze. Furthermore, the tube 21 contains a quantity of evaporatable heat-transporting medium, for example, sodium (not shown).

Each of the pistons 1, 2, 3 and 4, through the associated drive rod 9, co-operates with a swash-plate 27 by way of sliding bodies 26.

The plate 27 is mounted on a shaft 28 in a manner such that it cannot rotate with respect to the shaft 28 but can be tilted relative thereto about a tilting shaft 29.

For tilting the swash-plate 27 about the tilting shaft, the plate is pivotably connected to a pair of pistons 31, 32 at a point 30 on one side of the tilting shaft and to a pair of pistons 34, 35 at a point 33 on the opposite side of the tilting shaft.

The pistons 31 and 35 situated on one side of the swash-plate 27 bound a space 36, whilst the pistons 32 and 34 situated on the other side of the plate 27 bound a space 37.

The spaces 36 and 37 can be connected at will, via a duct 38 and a control device 39, to a liquid supply duct 40 or a liquid discharge duct 41.

The control device 39 is coupled, via an electrical control circuit 42, to a pedal 43 which is pivotable about a shaft 44. It will be obvious that the pedal 43 can have a variety of shapes in practice and that instead of an electrical coupling between this pedal and the control device 39, an hydraulic, pneumatic or mechanical coupling can alternatively be used.

Liquid can be supplied to or removed from the spaces 36 and 37 by moving the pedal 43. The distance between the pistons 31 and 35 and between the pistons 32 and 34 is thereby varied, resulting in a variation in the inclination of the swash-plate 27 relative to the shaft 28. As a result, the stroke of the pistons 1, 2, 3 and 4 is varied, and hence the power delivered by the engine.

The valves 16 in the ducts 15 are controlled, via an electrical control circuit 45, by an electrical switch 47, the valves 19 in the ducts 18 being similarly controlled via an electrical control circuit 46. The switch 47 is actuated through a rod 48 which is rigidly connected to a pedal 49. The assembly of pedal 49 and rod 48 is pivotable about the shaft 44. The rod 48 furthermore co-operates with a rod 50 which is rigidly connected to the pedal 43, and the rod 48 can abut against an abutment 51. The pedals 43 and 49 are depressible against the action of compression springs 52 and 53 respectively.

During normal operation of the engine, heat stored in the heat-storing material **23*a* is transported to the heater pipes 17 by evaporation of heat-transporting medium in the tube 21 at the area of the reservoir 23 and by condensation of the evaporated medium on the heater pipes 17 while giving up heat thereto. The condensate is returned from the heater pipes 17 to the outer surfaces of the walls of the reservoir 23 via the capillary lining 25**.

The engine delivers power when the pedal 43 is depressed, which causes liquid to be supplied to the spaces 36 and 37 so that the swash-plate 27 assumes an inclination corresponding to a given stroke of the pistons 1–4. Under the action of the compression spring 53 the switch 47 remains in a position such that the valves 16 are open and the valves 19 are closed. When engine braking is required, first the pedal 43 will be released, which results in a decrease of the power supplied by the engine (smaller inclination of the swash-plate). Engine braking is then effected by pushing down the pedal 49. The rod 48 then releases the switch 47, with the result that the valves 16 are closed and the valves 19 are opened. The engine starts to operate as a heat-pump while maintaining the direction of rotation, with the result that the spaces 11 change from compression spaces to expansion spaces and the spaces 10 become compression spaces instead of expansion spaces. The mechanical braking energy applied to the engine shaft is then converted into heat in the spaces 10. This heat is given up, via the heater pipes 17, to heat-transporting medium in the tube 21 which medium consequently evaporates, flows in the vapour phase to the reservoir 23, which is now at a lower temperature than the heater pipes 17, and condenses on the reservoir 23 while giving up heat thereto. The heat obtained by the conversion of the braking energy is thus stored in the heat-storing material **23*a***.

The value of the braking torque (reverse torque) is substantially dependent on the stroke of the pistons 1–4.

In order to ensure that an adequate braking torque is gradually obtained in any situation, during braking the pedal 43 is moved down with the pedal 49 through the cooperation between the rod 48 and the rod 50. This results in more liquid being supplied to the spaces 36 and 37, so that the swash-plate 27 assumes a greater inclination with the result that a longer stroke of the pistons 1–4, and hence a greater reverse torque, is obtained.

Obviously, a variety of other embodiments of the means for controlling the valves 16 and 19 and the mechanism whereby the pedal 43 is moved with the pedal 49 are possible.

In the drawings, the reservoir containing the heat-storing material is shown arranged inside a heat pipe. Obviously, the reservoir can alternatively be arranged outside the heat pipe, or the heater pipes can be arranged inside the reservoir so that they are in contact with the heat-storing material, thus dispensing with the need for a heat pipe.

What is claimed is:

1. A hot-gas reciprocating engine comprising at least three double-acting pistons which are each reciprocable in an associated cylinder and which each separate therein a space of variable volume and lower temperature during operation from a space of variable volume and higher temperature during operation, the space of lower temperature in each cylinder being connected, via at least one of a plurality of regenerators and at least one of a plurality of heat-exchangers, to the space of higher temperature in one of the other cylinders, the volume variations of each space of higher temperature leading in phase those of the space of lower temperature connected thereto; at least one heating device for supplying heat to the heat exchangers, which device comprises at least one reservoir which contains a heat-storing material which can be heated and which material is in heat-exchanging relationship with the heat exchangers during operation; a respective drive rod coupled to each of the pistons, which co-operates, by way of a sliding body, with a swash-plate which is tiltably mounted on a rotatable shaft; and means for tilting the swash-plate to increase or decrease its inclination relative to the shaft in order to increase or decrease, respectively, the stroke of the pistons; characterized in that each space of lower temperature is also connected, via one of the regenerators and one of the heat exchangers, to one of the spaces of higher temperature, in which space the volume variations lag in phase behind those in the space of lower temperature connected thereto, the connections between each space of lower temperature and the two spaces of higher temperature connected thereto including valves which are operated by means for selectively opening one of the two connections, which means for opening, when opening the connections between the spaces of lower temperature and the spaces of higher temperature wherein the volume variations occur which lag in phase behind those in the relevant space of lower temperature, causes the means for tilting the swash-plate to be operated to tilt the plate further in the direction to increase its inclination, the means for tilting the plate being operable independently of the means for selectively opening one of the two connections.

* * * * *